United States Patent [19]

Aguilar

[11] Patent Number: 4,879,545

[45] Date of Patent: Nov. 7, 1989

[54] SAFETY INDICATOR DEVICE FOR LOW WATER CROSSING

[76] Inventor: Alberto B. Aguilar, P.O. Box 1413, Uvalde, Tex. 78802

[21] Appl. No.: 167,865

[22] Filed: Mar. 14, 1988

[51] Int. Cl.[4] ..... G08B 21/00

[52] U.S. Cl. ..... 340/624; 340/907; 73/308; 73/311; 200/84 R

[58] Field of Search ..... 200/84 R, 84 B, 61.2; 73/308, 311; 340/623, 624, 907; 116/228

[56] References Cited

U.S. PATENT DOCUMENTS

| | | | |
|---|---|---|---|
| 2,607,835 | 8/1952 | Bonar | 340/624 |
| 3,185,789 | 5/1965 | Gunther | 340/624 X |
| 3,673,587 | 6/1972 | Barach | 340/624 X |
| 4,080,985 | 3/1978 | Eagle | 340/624 X |
| 4,081,638 | 3/1978 | Thorn et al. | 200/84 R |

*Primary Examiner*—Joseph A. Orsino
*Assistant Examiner*—Joseph A. Hofsass
*Attorney, Agent, or Firm*—Cox & Smith Incorporated

[57] ABSTRACT

A signalling device for signalling danger from water over a low water crossing area is provided. The device has a support post, a message panel, and flashing lights in electrical connection with an energy source, the electrical connection being completed by triggering a switch lever by either a tank float rigidly mounted to a bottom end of a centrally disposed elongate guide member or by a donut-shaped tank float received about the elongate guide member and stopped by a stop member, either the rigidly mounted float pushing the elongate rod upwards and triggering the switch lever, or the donut shaped tank float and stop pushing the elongate rod upwards and triggering the switch lever.

5 Claims, 2 Drawing Sheets

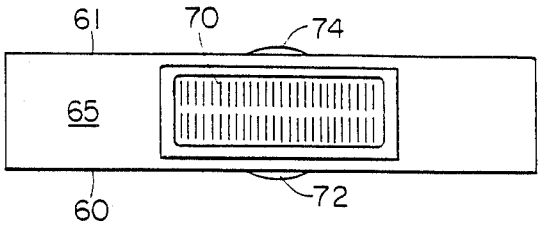
FIG. 3
FIG. 4
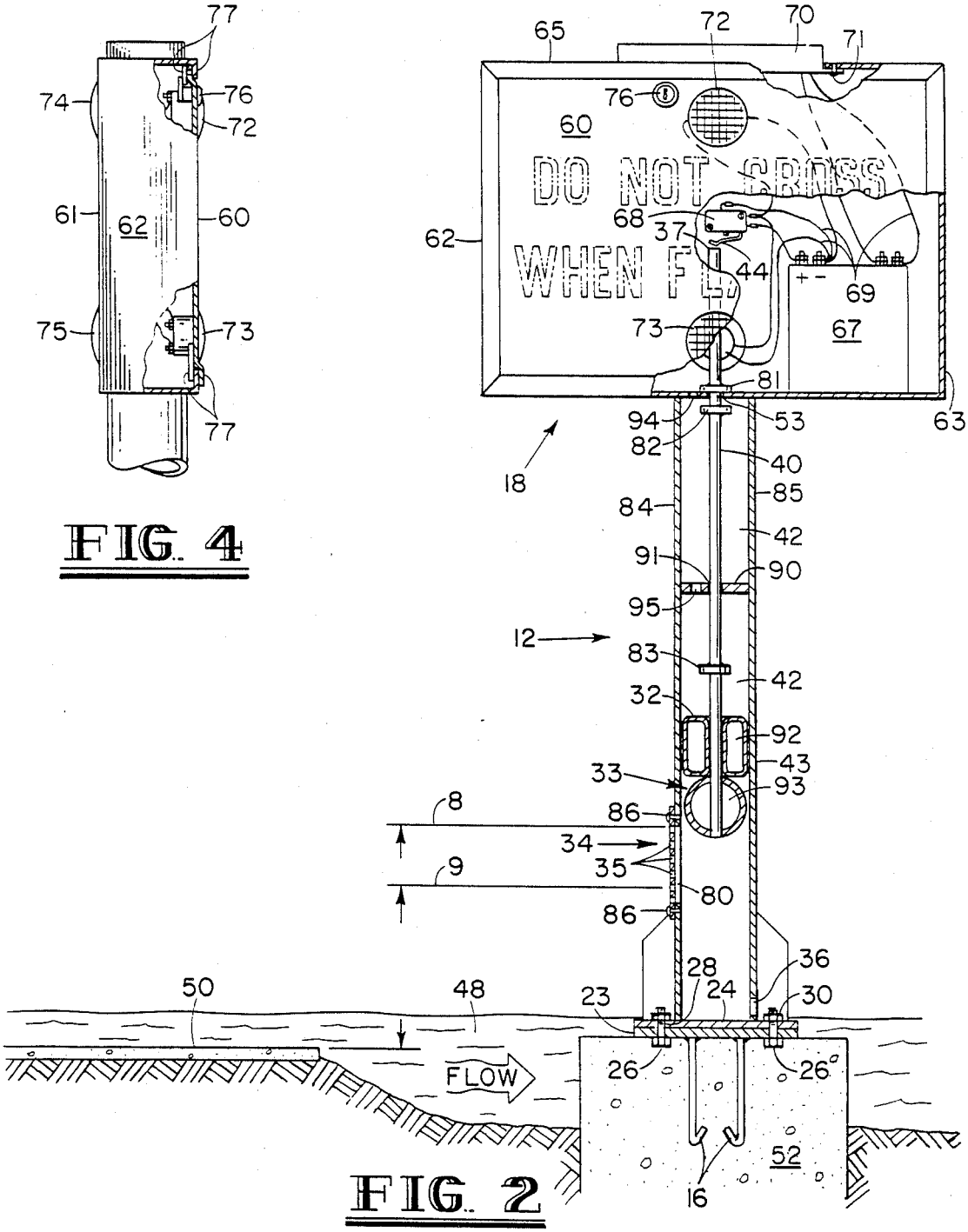
FIG. 2

SAFETY INDICATOR DEVICE FOR LOW WATER CROSSING

BACKGROUND OF THE INVENTION

The present invention pertains to a safety indicator for warning motorists when water over a low water crossing or other road is unsafe for crossing by the motorists. More particularly, the present invention relates to a solar-powered flashing signal which is activated by water rising within a hollow support post, the post being provided with apertures at pre-determined levels for permitting communication of water with the hollow space of the post wherein means for controlling the signal are located.

Water over the roadway can and often does present a perilous trap to motorists. When floodwaters cover a road, particles in the water and other factors typically prevent a motorist from seeing the road surface beneath the water, and a motorist can easily be deceived as to the depth of the water. What may appear as an inconspicuous puddle of standing water on the road may actually turn out to be a five foot dip filled with water in a flood plain. The ramifications to a deceived motorist range from inconvenience to death, and such dangers are increasingly critical with increasing flow rates of the water. For instance, a small creek overflowing three feet above a low water crossing may present force enough to sweep a school bus into and down the creek. Although such dangers are not new, the hazards persist. Despite the almost everpresent graduated flood gauge adjacent low water crossings, such warnings time and again go unnoticed and, even when the flood gauges are noticed, motorists too often find their vehicles overwhelmed by the power that a few inches of swiftly flowing water has.

As it has heretofore been, in order to adequately protect the public from such hazards, authorities must barricade low water crossings when conditions become too dangerous. This requires adequate barricades, frequent monitorings of the crossings and, consequently, added costs for the authorities.

Therefore, the present inventor has endeavored to provide a safety indicator which will automatically signal danger either from what has been determined as an excessive depth of standing water over a road, or similar danger from an excessive rate of flow of water over the road as is frequently observed in flash-flooding. It is a primary object of the present invention to provide a simple warning device for signalling when water over the roadway, regardless whether standing or flowing, is too dangerous for motorists. Another object of the present invention is to achieve the other objects while successfully coping with solids and debris suspended in the water.

Another object of the present invention is to provide a low-water crossing warning device which can be easily installed in existing hollow support pipe signposts of the kind commonly available and in use for warning signs.

Yet another object of the present invention is to provide a low water crossing warning device that is highly visible at any hour of the day or night, despite any inclement weather conditions, and yet which requires no external power source, as such power sources might be cut of during a flood or violent storm.

A further object of the present invention is to provide a low water crossing warming device, the activation of which is dependent upon the water level, the water velocity and combinations of those factors, which warning device can be set to be activated at pre-determined standing water height or a predetermined flowing water height.

It is also an object of the present invention to ensure reliability by providing back-up control means for controlling a low water crossing warning device where primary controlling means present the possibility of failure.

Those and other objects and advantages of the present invention will be made apparent to those skilled in the art who have the benefit of the following detailed description of a presently preferred embodiment of the invention.

SUMMARY OF THE PRESENT INVENTION

These objects and advantages are accomplished by providing a water danger indicating device adapted for mounting to a standard, vertically-mounted support pipe alongside a low water crossing. Water flowing over the low water crossing communicates with the interior of said support pipe through openings provided therein for controlling the indicating device. A warning signal of said indicating device is primarily activated when the water height within the pipe rises above a pre-determined level but is also activated at lower water heights when the water is flowing more swiftly over the crossing. The pipe is modified to combine the level of the water outside the pipe with the velocity of that water relative to the pipe for raising and lowering a control rod within the pipe. Thus, the activation of the indicating device depends on two factors—both the level and the flow-rate of the water over the road. A first float rigidly connected to the control rod and a second, back-up float in slidable relation with said control rod are provided for control of the control rod movement. The device of the present invention generally comprises a support pipe and a sign mounted to the support pipe which provides the warning signal. The warning signal incorporates both a warning message and one or more capacitor-controlled blinking light elements. Said blinking light elements are activated by a switch which operatively empowers said light elements with electricity provided by a battery that is recharged by a solar panel and first and second means for activation of the trigger means when water rises to a predetermined height within the support pipe.

BRIEF DESCRIPTION OF THE DRAWINGS

FIG. 2 is a partially cutaway elevation view of the preferred embodiment.

FIG. 3 is a top view of the embodiment of FIG. 2.

FIG. 4 shows a side elevation of a portion of the preferred embodiment.

DETAILED DESCRIPTION OF THE PREFERRED EMBODIMENT

Figure 1:
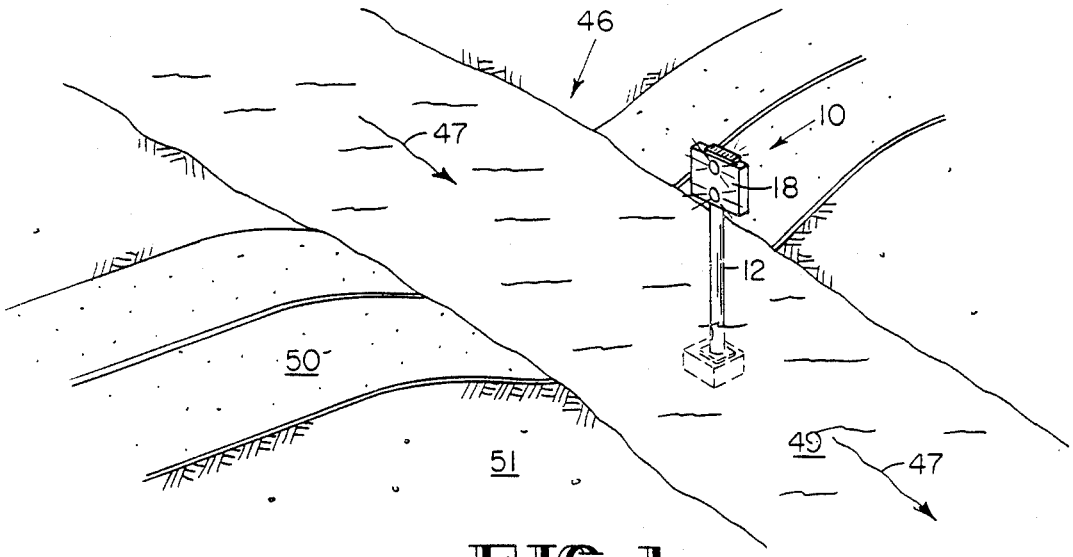
FIG. 1 is a bird's eye perspective view of the presently preferred embodiment of the present invention employed in typical fashion adjacent a flooded low water crossing.

FIG. 1 shows a signalling device 10 for signalling when water 49 over road 50 at low water crossing area 46 is too swift and/or too high for safe passage by a motorist (not shown). Water 49 is shown flowing in the direction of arrows 47 and arrow 48 (shown in FIGS. 2, 5 and 6). Signalling device 10 generally comprises a support post 12 and sign board 18. Sign board 18 is rigidly mounted atop support post 12 which is rigidly anchored to the ground 51 adjacent road 50.

Sign board 18, referring to FIG. 2, is a box-like enclosure enclosing enclosed space 19. The box-like structure is defined by front face 60, rear face 61 (indicated in FIG. 3), side panels 62 and 63, lower panel 64, and top panel 65. Rechargeable battery 67, electrical switch 68 and electrical wiring 69 are enclosed within space 19. Sign board 18 provides a water resistant enclosure enclosing space 19 for protecting electrical components 67–69, 72–74 therein, but sign board 18 is not an airtight enclosure. Electrical switch 68 is rigidly connected to the interior surface of sign board 18 by a bracket (not shown). Solar panel 70 (shown in FIG. 3) is mounted through an appropriate opening in top panel 65 by screws 71 for enabling exposure of panel 70 to solar energy. Solar panel 70, further, is operatively connected to battery 67 for enabling recharge of battery 67 with low current electricity generated by solar panel 70. Lower panel 64 is provided with holes 53 and 94 therethrough. Rear face 61 is permanently bonded to panels 62 through 65, but front face 60 is removably secured to panels 62 through 65 by standard locking mechanism 76 and flanges 77. Locking mechanism 76 rigidly secures front face 60 to panels 62 through 65, but upon unlocking locking mechanism 76 with the appropriate key (not shown) front face 60 is removable for enabling access to battery 67, switch 68, wiring 69, solar panel 70, and light elements 72 through 75.

Panels 60 and 61 are provided with means for warning motorists on road 50 not to cross low water crossing 46 when the conditions of water 49 are too dangerous. Each of faces 60 and 61 are message panels bearing the message "DO NOT CROSS WHEN FLASHING" as shown in relation to front face 60 in FIGS. 2, 5, and 6. Light elements 72–75 are mounted integrally with front face 60 and rear face 61 as shown in FIGS. 2–4 for operatively producing light signals that are visible from the exterior of sign board 18 when light elements 72–75 are activated. The light signals produced by light elements 72–75 are for warning motorists and for drawing the attention of such motorists despite inclement weather conditions. Light elements 72–75 are capacitor-controlled blinking lights which are electrically connected to battery 67 and switch 68 in a manner such that light elements 72–75 are activated when and only when switch lever 44 of electrical switch 68 is engaged by upper end 37 of elongate rod 40. In essence, switch lever 44 functions as a triggering means for enabling activation of light elements 72–75.

Referring to FIG. 2, support post 12 is anchored to ground 51 by means of anchor bars 16 embedded in concrete foundation 52. Anchor bars 16 are rigidly connected to anchor plate 23 which has bolts 26 protruding upwardly through holes therethrough. Anchor plate 23, anchor bars 16, and bolts 26 are partially set in concrete foundation 52 when concrete foundation 52 is freshly poured in order that anchor plate 23 is securely anchored to ground 51. Base plate 24 is rigidly mounted to the lower end of post 12 and rests on anchor plate 23 with bolts 26 extending upwardly through holes 28 provided in base plate 24. Base plate 24 is rigidly connected to anchor plate 23 by means of nuts 30 threadably received on bolts 26. Note that, although post 12 is a tubular pipe in this presently preferred embodiment, an alternative embodiment (not shown) of the present invention is provided with a post having a square-shaped cross-section instead of post 12. Note also that alternative securing means as are known in the art (for example, poured concrete) may also be utilized for mounting said support post 12 to ground 51.

Slidably received within hollow space 42 of support post 12 are floats 32 and 33, and control rod 40. Upper end 37 of control rod 40 extends into enclosed space 19 through hole 53 in lower panel 64. Guide 90 is a thin circular disc rigidly connected to the interior surface of post 12. Guide 90 has holes 91 and 95 therethrough. Rod 40 is slideably received through each of holes 91 and 53. Hole 95 enables free fluid communication through guide 90. Hole 94, provided through panel 64, enables free fluid communication between spaces 19 and 42.

Float 33 is a spherical float, and float 32 is a donut-shaped float. Float 33 is rigidly connected to lower end 38 of rod 40. The donut shape of float 32 is coaxial with the longitudinal axis of rod 40. Float 32, therefore, moves freely in the vertical direction relative to rod 40 except that the movement of donut-shaped float 32 is limited relative to rod 40 by stop 43 and the upper surface of float 33. Control rod 40 is constrained concentrically with pipe 12 by the outer perimeter of float 33, by hole 53 in lower panel 64, and by hole 91 in guide 90. By such constraint, the upper end 37 of rod 40 is directed to engage switch level 44 as rod 40 is elevated from the orientation shown in FIG. 2.

Control rod 40 is a lightweight rod which provides means for controlling the activation of light elements 72–75 by actuating and deactuating switch 68 in response to forces conveyed by floats 32 and 33. Control rod 40 is provided with stops 81 and 82 rigidly connected thereto for limiting movement of rod 40 relative to lower panel 64 in order to minimize excessive movement of rod 40, thereby reducing stress and wear on other parts of the preferred embodiment which are related to rod 40. Stop 81 is rigidly connected to rod 40 for limiting movement of float 32 relative to rod 40. Stops 81–83 are washer-like discs rigidly connected to control rod 40 during assembly of signalling device 10.

Figure 5A:
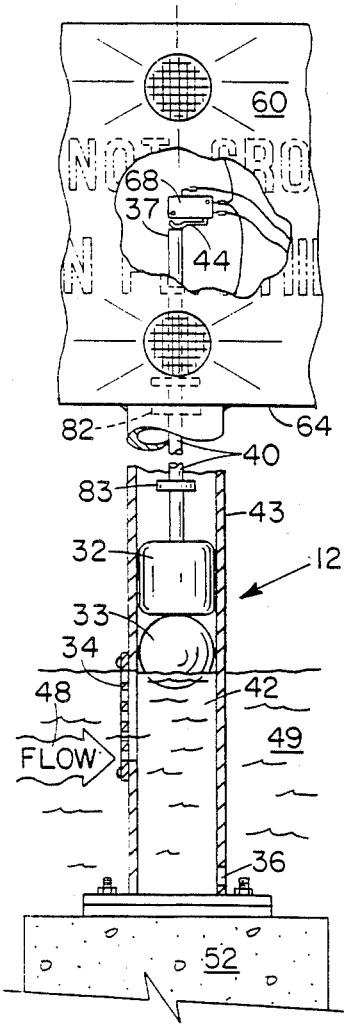
FIG. 5A is a partially cutaway elevation view of the preferred embodiment.
Figure 5B:
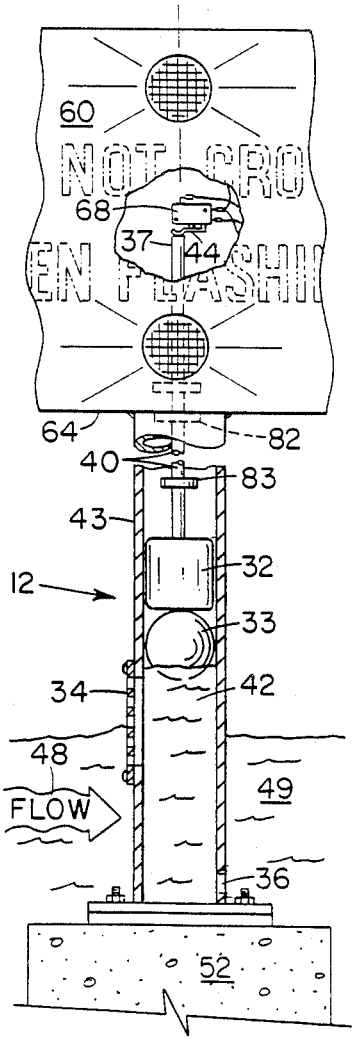
FIG. 5B is a partially cutaway elevation view of the preferred embodiment.
Figure 6:
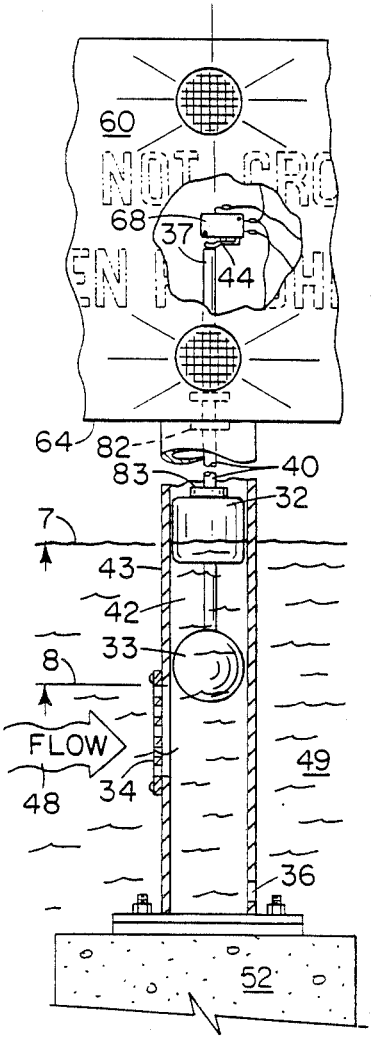
FIG. 6 is a partially cutaway elevation view of the preferred embodiment.

In FIG. 2 rod 40 is shown in the lowered position (as characterized by abutment of stop 81 against lower panel 64), whereas rod 40 is shown (in hidden lines) in the raised position (as characterized by abutment of stop 82 against lower panel 64 and by engagement of upper end 37 with switch lever 44) in FIGS. 5 and 6. Only slight upward movement of rod 40 from said lowered position moves rod 40 into said raised position. Switch 68 is actuated for enabling activation of light elements 72–75 when rod 40 is in said raised position. Switch 68 is unactuated when rod 40 is in said lowered position. Gravity tends to force rod 40 into said lowered position. Hence, as upper end 37 is disengaged from switch lever 44 when rod 40 is in said lowered position, Switch 68 is deactuated, thereby disabling activation of light elements 72–75.

Fluid flows into and out of hollow space 42 of support post 12 through opening 36, hole 53, and opening 80. Opening 36 is a hole through the wall of post 12 in close proximity of base plate 24 and is oriented closest to the trailing edge 85 of support post 12 in relation to the flow of water 49. Screen 34 is a strainer for straining particulate matter from fluid entering through opening 80. Screen 34, having plurality of holes 35 therethrough, is positioned over large, approximately square-shaped opening 80 which passes through the side of post 12. Screen 34 is rigidly connected to post 12 by screws 86. Opening 80 is diametrically opposite opening 36 relative to post 12. Thus, opening 80 is on the upstream side of post 12 (i.e. on leading edge 84) and opening 36 is on the downstream side of post 2 relative to the flow of water 49.

Opening 36 not only functions as an opening for inlet of water into hollow space 42, but also functions as a drain hole to drain hollow space 42 when water 49 has receded from around post 12. Opening 36 is larger in diameter than any of openings 35 for enabling small particulate that enters through screen 34 to exit through opening 36. Thus, since both water and particulate will tend to enter through opening 80 rather than opening 36 (because opening 80 is upstream from 36), post 12 incorporates means for preventing clogging of fluid passage into space 42 from water 49. Note also that, in the unlikely event that each of openings 35 becomes clogged, water could still flow through opening 36. Water is, therefore, able to enter hollow space 42, which entry tends to cause floatation of floats 32 and 33 which may, in turn, cause rod 40 to be elevated, thereby effectively causing the activation of light elements 72–75.

In operation, as the level of water 49 rises, water enters hollow space 42 first through opening 36 and finally through openings 35. Such entry of water 49 into hollow space 42 tends to force floats 32 and 33 upwardly due to buoyancy of floats 32 and 33. The upward force caused by such buoyancy increases as to each float 32 and 33 as that float becomes more fully submerged. If the flow velocity of water 49 adjacent post 12 is minimal, then the level of water in space 42 is approximately equal to that outside post 12. However, due to elevated fluid pressure created within space 42 by water entering opening 80 from the upstream direction, the level of water within space 42 (as shown in FIG. 5B) is higher than that outside post 12 when water 49 is flowing through opening 80 with notable velocity in the direction of arrow 48.

Furthermore, for any given depth (or level) of water 49 adjacently outside post 12, the height (or level) of water within space 42 increases as the flow velocity of water 49 increases relative to post 12. Thus, the level of the water within space 42 is dependent on both the level and the velocity of water 49 adjacently outside post 12.

Engineered based on that relationship between water 49 and the water level in space 42, the relative sizes and elevations of openings 35 and 36 are such that water within space 42 reaches approximately the same particular height, the "control height", whenever the velocity and depth of water 49 combine to produce conditions that make the low water crossing 46 too dangerous for motorists. Typically, the authorities responsible for road 50 predetermine a range of critical depths of water 49 relative to road 49, which critical depths are considered to be potentially too dangerous depending also on the velocity of the water 49. Elevation 8 is the upper limit and elevation 9 is the lower limit of such a range of critical depths. Depths of water 49 greater than the upper limit 8 of said range of critical depths are automatically considered to be too dangerous, regardless of the velocity of water 49. The lowest of holes 35 is at an elevation slightly below the lower limit 9 of said range.

The height of float 33 when rod 40 is in the lowered position is a height at which the buoyant forces acting on float 33 are sufficient to initiate movement of control rod 40 upwardly whenever the condition of water 49 over the low water crossing 46 is too dangerous to attempt crossing thereof by a motorist. In essence, float 33 is approximately located at the previously described control height. Said control height is at upper limit 8 of the range of critical depths since water 49 is too dangerous when it reaches upper limit 8 regardless of flow velocity.

Thus, as the level of water 49 rises, light elements 72–75 are activated when water 49 reaches a particular level between lower limit 9 and upper limit 8 of the range of critical water heights. Said particular level in that range is any of an infinite number of possibilities depending upon the flow velocity of water 49. If the flow velocity of water 49 is extremely swift, the level of water within space 42 will reach the previously described control height when the level of water 49 rises to or closely above lower limit 9. If water 49 has a minimal flow velocity, water within space 42 will reach said control height when water 49 rises to upper limit 8. If the flow velocity of water 49 is somewhere between minimal and extremely swift, then the water within space 42 will reach said control height when the level of water 49 is likewise at an elevation somewhere within said range of critical depths.

After reaching said control height, if float 33 is properly sealed and otherwise is free to move in the vertical direction, water within space 42 causes control rod 40 to rise along with float 33, thereby engaging switch lever 44. Upon such engagement of switch lever 44, light elements 72–75 are empowered to be activated by battery 67. When the water within space 42 recedes beneath said control height according to the conditions of water 49 outside post 12, the weight of floats 32 and 33 and control rod 40 cause control rod 40 to disengage switch lever 44, thereby deactivating light element 72–75. During all periods in which solar element 70 is exposed to solar energy (not shown), solar panel 70 recharges battery 67 so that signalling device 10 is a self-contained, virtually maintenance-free apparatus.

Floats 32 and 33 are each formed of lightweight plastic and are each provided with buoyancy primarily by gas enclosed within respective spaces 92 and 93. Ordinarily, float 33 controls the movement of control rod 40 since movement of float 33 is conveyed to rod 40. In order to secure float 33 to rod 40, rod 40 runs through float 33 and is rigidly connected thereto in a manner which seals space 93 from leaks. Such connection, however, presents the possibility of eventual leakage into space 93. Therefore, float 32 is provided as a secondary (or "back-up") float for controlling movement of control rod 40 in the event of any leaks in float 33. The donut-like shape and the slideable connection of float 32 relative to rod 40 minimize the possibilities of any leakage of water into space 92, thereby ensuring proper function of float 32.

However, even if float 33 has a leak, float 33 is capable of raising rod 40 in response to increased fluid pressure in space 42, thereby actuating switch 68. Because the perimeters of float 33 are relatively close to the interior of post 12, float 33 partially obstructs flow through the space therebetween. Such flow obstruction characteristics provide float 33 with means for responding to fluid pressure in space 42. If fluid pressure beneath float 33 is greater than that above float 33, then float 33 tends to rise within space 42. Thus, even if float 33 has diminished buoyancy, float 33 will actuate switch 68 in response to water flowing swiftly through opening 80 if such water rises above upper limit 9.

In the event that float 33 develops a leak or otherwise is inadequate to raise rod 40, the buoyancy of float 32, especially when combined with any remaining buoyancy or other upward forces acting on float 33, is sufficient to elevate rod 40 to the raised position. In that case, referring to FIG. 6, the level of water 49 must rise above upper limit 8 approximately to the elevation indicated at 7 in order to actuate switch 68. As the level of water 49 rises above upper limit 8 toward elevation 7, float 32 is first caused by its buoyancy to float upwardly from contact with float 33 as the level of water within space 42 reaches the appropriate height. Float 32 then continues to rise with the level of water within space 42 until the upper surface of float 32 engages stop 83. Once the upper surface of float 32 engages stop 83, float 32 exerts upward forces on control rod 40. Such upward forces (in combination with any upward forces acting on float 33) raise control rod 40 along with float 32, thereby actuating switch 68 to activate light elements 72–75. Subsequently, switch 68 is deactuated when the level of water within space 42 enables float 32 to recede from engagement with stop 83.

Note also that as the particular needs may justify, which needs may vary due to the condition of the road, other safety precautions adjacent the road, or the particular location of signalling device 10 relative to the flow of water 49, the relative characteristics of floats 32 and 33 in combination with the weight of rod 40 and other characteristics may be altered as is needed or desired to control the responsiveness of device 10. Similarly, the relative sizes of openings 35 and opening 36 may be modified to "engineer" the desired characteristics of operation of the warning device 10 for a particular application.

From the foregoing description and illustration of this invention, it is apparent that various modifications can be made by rearrangement of the elements or by substitution to produce similar results. It is, therefore, the desire of the Applicant not to be bound by the description of this invention as contained in this specification, but to be bound only by the claims as appended hereto.

What is claimed is:

1. A signaling device for signaling when characteristics of water over a low-water crossing are excessively dangerous, comprising:

an elongate support pipe positioned approximately vertically;

an electrical circuit including a battery;

triggering means rigidly connected to said elongate support pipe and electrically connected in said electrical circuit for closing said electrical circuit;

a means for conveying a signal comprising a sign and a blinking light element, said sign being mounted to said elongate support pipe and being provided with a warning message, said blinking light element being electrically connected in said electrical circuit;

an elongate member positioned within said elongate support pipe in slidable relation therewith an operatively connected at a first end to said triggering means for actuating said triggering means, said elongate member being provided with a stop rigidly connected thereto;

a first means for actuating said triggering means when water rises within said elongate support pipe to a predetermined height, said first actuating means comprising a float slidably received within said support pipe and rigidly mounted to a second end of said elongate member;

apertures received through the wall of said elongate support pipe at predetermined locations thereon, for enabling water to rise within said elongate support pipe to an elevation which represents the danger of water surrounding said elongate support pipe, said apertures being adapted for prohibiting the obstruction thereof by debris;

a second means for actuating said triggering means when water rises to a predetermined height within the support pipe, said second actuating means comprising a float having a hole therethrough, said elongate member being received through the hole of said second actuating means;

a straining means mounted to said elongate support pipe for straining particulate matter from water flowing through said apertures; and a drain hole for permitting water to exit from within said elongate support pipe.

2. An apparatus for enabling the transmission of a warning signal when characteristics of water relative to a throughway are excessively dangerous comprising:

an elongate support positioned approximately vertically and having an elongated hollow space therethrough;

an enabling means, such as a rod, slideably disposed within the elongate hollow space of said elongate support for enabling a signal;

a float slideably disposed within the elongate hollow space of said elongate support for vertically moving said enabling means in response to characteristics of water surrounding said elongate support, said float being operatively connected to said enabling means; and a second float slideably engaged with said enabling means, the movement of said second float being limited relative to said enabling means for vertically moving said enabling means in response to characteristics of the water surrounding said elongate support.

3. The apparatus of claim 2 wherein:

said elongate support is provided with means integral therewith for providing a representative sample of water within the elongate hollow space of said elongate support, said representative sample having characteristics that represent the height and the velocity of the water surrounding said elongate support.

4. The apparatus of claim 3 wherein said sample providing means comprises an opening through said elongate support on the leading edge of said elongate support relative to flow of the water surrounding said elongate support.

5. A signalling device for signalling when characteristics of water over a low-water crossing are excessively dangerous, comprising:

an elongate support pipe positioned approximately vertically, said elongate support pipe having an elongate hollow space therein;

an electrical circuit including an electrical power source;

triggering means rigidly connected to said elongate support pipe and electrically connected in said electrical circuit for closing said electrical circuit;

a means for signalling when electrically energized, said signalling means being mounted to said elongate support pipe and being electrically connected in said electrical circuit;

means for actuating said triggering means when water rises within said elongate support pipe to a predetermined height, said actuating means comprising a float slidably received within said support pipe and operatively connected to said triggering means; and means for defining an aperture in communication with the space within said elongate support pipe for enabling water to rise within said elongate support pipe to an elevation which represents the height of water surrounding said elongate support pipe:

an elongate member positioned within said elongate support pipe in slidable relation therewith, said elongate member being operatively connected at a first end to said triggering means for actuating said triggering means, and said elongate member being provided with a stop rigidly connected thereto; and a second means for actuating said triggering means when water rises to a predetermined height within the support pipe, said second actuating means comprising a float slidably engaged with said elongate member;

wherein:

said first actuating means comprises a float slidably received within said support pipe and rigidly mounted to a second end of said elongate member; and said aperture defining means defines an aperture through the wall of said elongate support pipe at a predetermined location thereon for enabling water to rise within said elongate support pipe to an elevation which represents the danger of water surrounding said elongate support pipe.

* * * * *